US005713082A

United States Patent [19]

Bassette et al.

[11] Patent Number: 5,713,082

[45] Date of Patent: Feb. 3, 1998

[54] SPORTS HELMET

[75] Inventors: Aldean Burdett Bassette, Palm Beach Gardens; Nicole Durr, Palm Beach, both of Fla.

[73] Assignee: A.V.E., West Palm Beach, Fla.

[21] Appl. No.: 615,703

[22] Filed: Mar. 13, 1996

[51] Int. Cl.[6] ..... A42B 3/00

[52] U.S. Cl. ..... 2/412; 2/422; 2/424; 2/425

[58] Field of Search ..... 2/410, 411, 412, 2/414, 422, 424, 425, 9

[56] References Cited

U.S. PATENT DOCUMENTS

| | | | |
|---|---|---|---|
| 2,296,335 | 9/1942 | Brady | 2/412 |
| 2,758,304 | 8/1956 | McGowan | 2/411 |
| 3,155,981 | 11/1964 | McKissick et al. | 2/422 |
| 3,174,155 | 3/1965 | Pitman | 2/411 |
| 3,242,500 | 3/1966 | Derr | 2/412 |
| 3,435,460 | 4/1969 | Grant | 2/422 |
| 3,445,860 | 5/1969 | Rodell | 2/422 |
| 4,633,531 | 1/1987 | Nimmons | 2/424 |
| 4,937,888 | 7/1990 | Straus | 2/411 |
| 4,947,490 | 8/1990 | Hayden . | |
| 5,035,009 | 7/1991 | Wingo et al. . | |
| 5,263,203 | 11/1993 | Kraemer et al. . | |
| 5,269,025 | 12/1993 | Broersma . | |
| 5,287,562 | 2/1994 | Rush, III . | |
| 5,309,576 | 5/1994 | Broersma . | |
| 5,421,035 | 6/1995 | Klose et al. . | |
| 5,481,762 | 1/1996 | Gentes et al. | 2/411 |

*Primary Examiner*—Michael A. Neas
*Attorney, Agent, or Firm*—McHale & Slavin

[57] ABSTRACT

An improved helmet constructed with a rigid shell having a soft outer covering which absorbs impacts and disperses energy thereby protecting the wearer of the helmet, as well as protecting the impacting object. When used for contact sports such as football, this covering is effective in preventing injuries resulting when the helmet is used as a striking object. The covering may be applied in segmented pieces or as a continuous layer around the shell which forms a solid frame-like structure. A face mask can also be covered with soft, durable covering and be mounted in such a manner to allow the covering to act as a shock absorber against sliding of the mask due to external forces.

13 Claims, 3 Drawing Sheets

SPORTS HELMET

FIELD OF INVENTION

This invention relates to head protection and in particular to an improved sports helmet having an externally cushioned facade providing improved impact protection at a reduced weight.

BACKGROUND OF THE INVENTION

The potential for an individual suffering a head injury while participating in a sporting activity depends upon the type of sport as well as the skill of its participants. High impact sports necessitate the use of the headwear, however, head injuries still occur despite participant skill. Headwear protection must also be capable of withstanding repeated impacts without imparting injury to the individual.

Headwear designed to protect an individual's head from injury is commonly referred to as a helmet. Proper helmet construction cannot be emphasized enough when used in such sports as football. in fact, it is a retirement that high school, college, and professional football players wear a helmet during play. Conventional football helmets include a hard outer casing which encompasses padding as placed against the user's head. As a result, when the user's head impacts a hard object the energy absorbed and displaced by the padding as it compresses against and between the user's head and the outer casing. However, despite the mandated requirement for helmet use and construction, head injuries are now occurring in notable numbers.

For this reason, numerous helmet manufacturers have patented various helmet designs and materials of construction in an effort to reduce head injury. U.S. Pat. No. 4,300,242 discloses a helmet manufacturing process which consists of textile reinforcement for the use of an impact resistant resin structure. U.S. Pat. No. 5,035,009 discloses a protective helmet and liner which consists of a force absorbing pad structure disposed upon the interior liner of a conventional helmet. U.S. Pat. No. 5,263,203 discloses an inflatable liner that is placed within the inner surface of a helmet and allows an individual to inflate the liner to meet the individual's requirements. U.S. Pat. No. 5,287,562 discloses a helmet construction having an interior padding and associated neckbrace for protection of the individual's head and cervical spine against axial impact forces. The common element in all such helmets is that the outer skeletal shell is constructed of an impact resistant hard plastic shell which operates as an offensive weapon should the individual wearing such a helmet impact another person's body at any portion where the body is unprotected. For instance, should an individual wearing one of the above helmets run into a person's knee the rigid shell may cause irreparable damage as it is uncommon for an individual to wear knee protection. However, should an individual be wearing the protection in the form of foam padding such an impact may be reduced or even eliminated.

In an effort to reduce head injuries, various protection groups are established for evaluating the safety of helmets and related accessories. The most notable is the nonprofit group National Operating Committee on Standards for Athletic Equipment, NOCSAE. The members of NOCSAE include the American College Health Association, American Orthopaedic Society for Sports Medicine, Athletic Equipment Managers' Association, National Association of Secondary School Principals, National Athletic Equipment Reconditioners' Association, National Athletic Trainers Association, National High School Athletic Coaches Association, Sporting Goods Manufacturers' Association and the College Football Association. NOCSAE was formed in 1969 in response to the need for a performance test standard for football helmets. Since then, standards have been developed for football, baseball, softball and lacrosse, with additional standards for other equipment currently being evaluated.

Since the 1960's media technology has increased coverage to bring about a greater exposure to sports. This in turn caused athletes to become involved at a younger age where they trained to perform more aggressively with goals such as athletic scholarships or lucrative professional contracts after college. Unfortunately, with the increased attention and involvement, serious injuries also became more prevalent. This was particularly evident in the sport of football where there were 32 fatalities in 1968 directly due to participation in organized competition, plus 4 more fatalities resulting from sandlot play.

Several problems confronted the NOCSAE, and other advocates, in their attempt to reduce football injuries. One of the problems in reducing injuries was the increased use of the head as the initial point of contact in blocking and tackling. It is a continuing concern that any improvements to equipment might lead to more and harder hits involving the head and the helmet. In other words, a competitive player—when given a helmet offering more internal protection for himself—might be more inclined to hit his opponent harder with this helmet. Safer internal padding results in a potentially more violent weapon in the hands of the user, particularly because of the hard outer casing being applied now with an even greater force.

While a downturn in head injury fatalities has been observed over the years due to the use of helmets, death and disabilities still continue to occur. The rule makers for football (e.g. the NCAA and NFL) have recognized that the helmet and face mask combination now play a dual role: while it reduced serious injuries, it has invited the use of the head as an offensive weapon. In 1976, rule-making committees were responsible for initiating changes which prohibited initial contact of the head in blocking and tackling (e.g. no "spearing" rules). While these rules have helped to reduce injuries, a rule in itself cannot prevent injury and/or maiming of a player. Such a rule can only invoke a yardage penalty, a fine, or at worst a suspension of a player. The injury and associated damage, however, will have still occurred to the victim player.

In response, groups such as the NOCSAE, NCAA, and NFL have also encouraged the application of warning labels on helmets and other equipment which warn the user of the potential dangers involved with playing a certain sport. Moreover, extra training regarding injury free methods of carrying the ball, blocking, and tackling have also been practiced. Together, such efforts to educate the players and coaches can only go so far to prevent injuries. If a piece of equipment, such as the helmet and/or face mask, continue to present a hard and injurious surface, then the injuries will invariably continue to occur as this surface is naturally brought into contact with other helmets, attached necks, and fragile body parts. Other contact sports such as hockey, lacrosse, and baseball will also continue to sustain such injuries under the present state of the equipment for similar reasons mentioned above.

Accordingly, a helmet is needed which provides superior comfort, padding, and weight advantages for the user, while simultaneously offering more resilient external surfaces for contact with opposing objects. This resilient external surface will, in itself, absorb energy and yet offer a softer impact surface. Hence, all players are protected from injurious impacts through the use of such equipment.

SUMMARY OF THE INVENTION

The present invention teaches an improved sports helmet which incorporates a unique energy absorbent material secured to the outer surface of a rigid shell. A face mask can also be utilized that incorporates the energy absorbent material for either coating of the mask or limiting movement of the mask. The shell and material coating provides for a helmet that can be less than half the weight of a solid plastic shell helmet.

The helmet can be made of a conventional shape for its desired application such as football, lacrosse, and hockey. The energy absorbent material is preferably a memory rubber such as vinyl nitrile sponge (VNS) being a combination of thermoplastic poly vinyl chloride and synthetic elastomer nitrile. The VNS covering can be further coated providing abrasion resistance and allowing for cosmetic effects. In this manner, the size and shape of the helmet can remain the same. Coloring of the material maintains an appearance identical to conventional helmet design.

The energy absorbing properties of the helmet provide protection to the wearer and further operate to reduce the impact ability of the helmet when contacting another object. In this manner if a helmet wearing participant struck an unprotected area of another player, the helmet provides a level of protection in the form of padding to both players. For instance, if a football player wearing a padded helmet strikes the unprotected knee of another player, the material will absorb a portion of the shock lessening damage to the knee. This energy absorbing properties is doubled when two players butt heads as each player having the coating helps to absorb the impact.

Accordingly, it is an objective of the present invention to provide a helmet with a soft, energy absorbent covering on its outer surfaces.

Still another objective of the present invention to provide a helmet that is lighter and safer than the football helmets currently employed.

It is a related objective of the present invention to provide a layered protection scheme for a user's head which includes a hard helmet shell with a layer of soft, energy absorbent covering on its inner and outer surface.

It is still a further objective of the present invention to provide a face mask for a helmet which incorporates soft, energy absorbent material along its outer surfaces.

It is yet another objective of the present invention to provide a helmet with a soft, energy absorbent material molded entirely around the inner and outer surfaces of a hard helmet shell.

It is a related objective of the present invention to provide a helmet with a soft, energy absorbent material molded around an inner web of structural support material.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objectives and features thereof.

DETAILED DESCRIPTION OF THE PREFERRED EMBODIMENT

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

Figure 1:
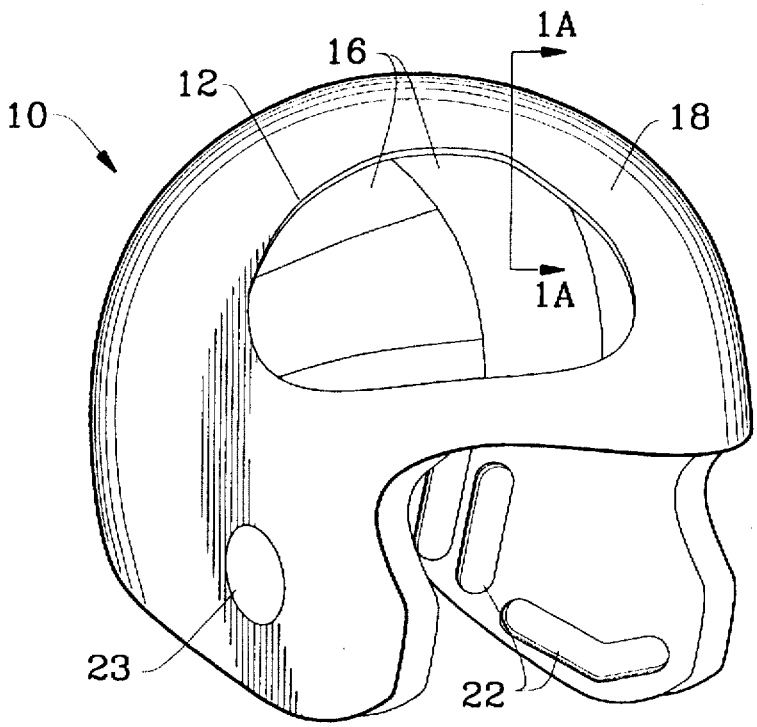
FIG. 1 is a front view of a helmet with a cutout of the helmet shell.

Referring to FIG. 1, a helmet 10 is illustrated having a cutaway 12 which shows the inner structure of the sponge-type padding that has been added to the outside of a hard helmet shell. In this embodiment, the padding has been added in segmented pieces 16 due to the spherical nature of the helmet. Such padding materials might include ½ inch thick Rubatex brand VNS which is cut to shape and bonded to the outside of a lightweight polycarbonate helmet shell with contact cement (e.g. Weldwood by DAP). A final coating of urethane Flexane liquid by Dercon) has been applied to seal the gaps/seams formed by the segmented pieces. Accordingly, the urethane coating makes the helmet smooth in appearance and cosmetically more appealing. The urethane also proves to be an effective surface for resisting abrasions and for providing environmental resistance to elements such as water, snow, sunlight, etc. Any necessary cutouts, like an earhole 23, could then be added to the helmet through the various layers.

Figure 1A:
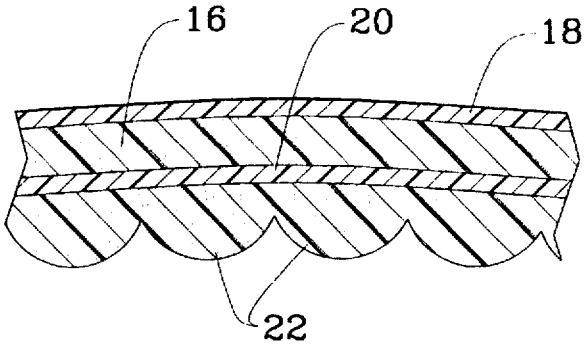
FIG. 1*a* a cross sectional view taken along lines AA of FIG. 1.

Referring now to FIG. 1A, a cross-sectional view of the helmet along cut A—A is shown. This view reveals the hard inner shell 20 as bounded on the top by padding layer 16. The urethane layer 18 then exists on top of padding layer 16. The inner part of the shell is lined with a foam (or sponge) padding 22 which conforms to the shape of a users head and provides breathable cushioning between the user's head and the hard central shell 20. As shown, this layer usually consists of a series of pillow-like pads, which are strategically placed and aligned for the comfort of the user.

Figure 2:
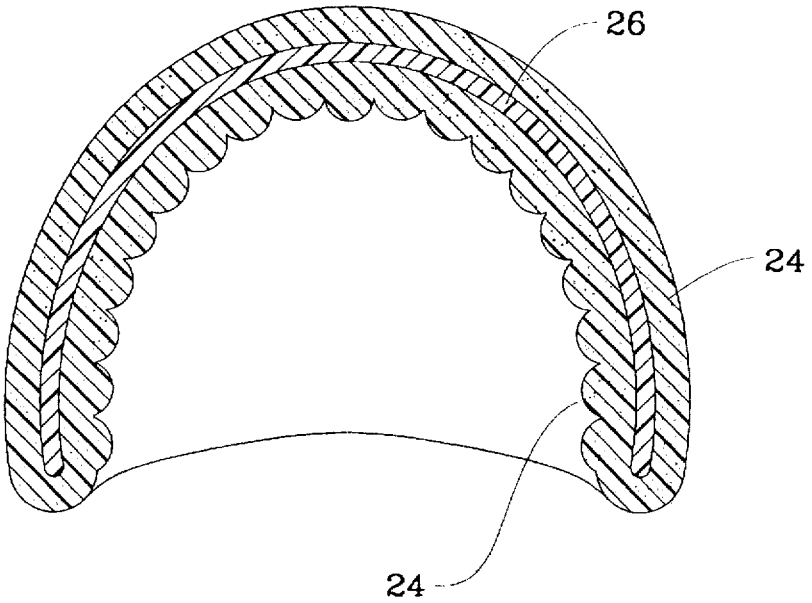
FIG. 2 is a cross sectional view of the shell.

Referring now to FIG. 2, a cross-sectional view of a helmet is shown whereby the VNS foam has been formed to encapsulate the inside and outside of the hard inner shell 26. This might be accomplished via a molding process or coating process around the inner helmet shell.

Figure 3:
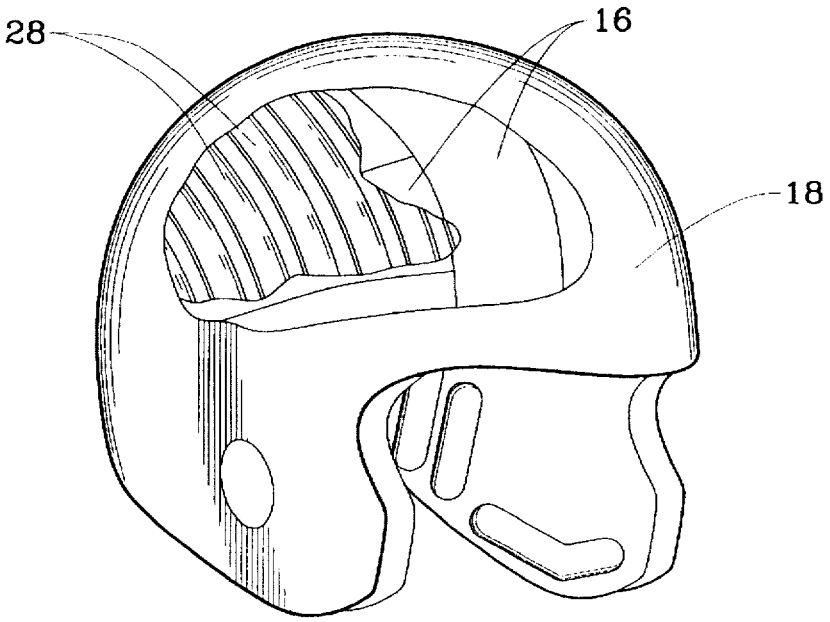
FIG. 3 is a perspective view of a helmet illustrating the layering of materials.

Referring now to FIG. 3, an alternative to the hard inner shell is proposed which might include a rigid frame-like structure 28 instead of a solid shell. As illustrated, this frame consists of a series of slats which are strategically attached to each other to provide structural rigidity, while also providing a lighter weight structure than a solid shell. The frame provides an attachment surface for the outer layer padding pieces 16 which can be cemented onto the outer surface of the structure 28. As before, the entire outer surface of the conformed pieces 16 is covered with a smooth urethane coating 18. Alternatively, like FIG. 2, the structural frame might be encapsulated on the inside and outside with VNS or another suitable padding material.

Figure 4:
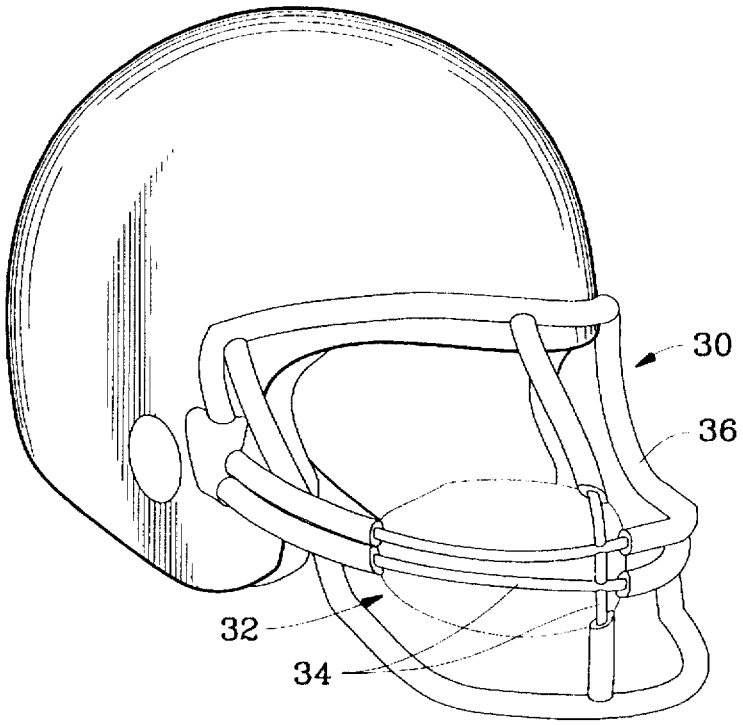
FIG. 4 is a partial view of a face mask.

Many sports also require a face mask to be attached to the helmet in order to protect the wearer's face from invading objects such as another helmet, a playing stick, an opponents hands, or a ball. The face mask is usually cast with thin cross sections as a single piece and hardened using high strength alloys (e.g. titanium, 4140 steel, 440 stainless steel, etc.) Given the dangers posed by the hard exterior surface of this face mask, it too could benefit from being covered with VNS or a similar type elastomer material. Referring now to FIG. 4, a covered face mask grid 30 is shown with a cutaway 32 to the bare grid wires 34. As before, this soft exterior covering 36 might be adhered in pieces to the grid 34, or alternatively might be molded to encapsulate the entire grid. Accordingly, the elastomer cushions the impact against the mask and reduces injuries to the players and opponents.

Other accessories which could also benefit from application of VNS and like materials include such items as the chin strap which sometimes has a cup with a hard outer edge. VNS could also be used to construct a headliner with an inflatable insert which would add to the cushioning effect and provide for an optimum fit of the helmet against the user's head.

Figure 5:
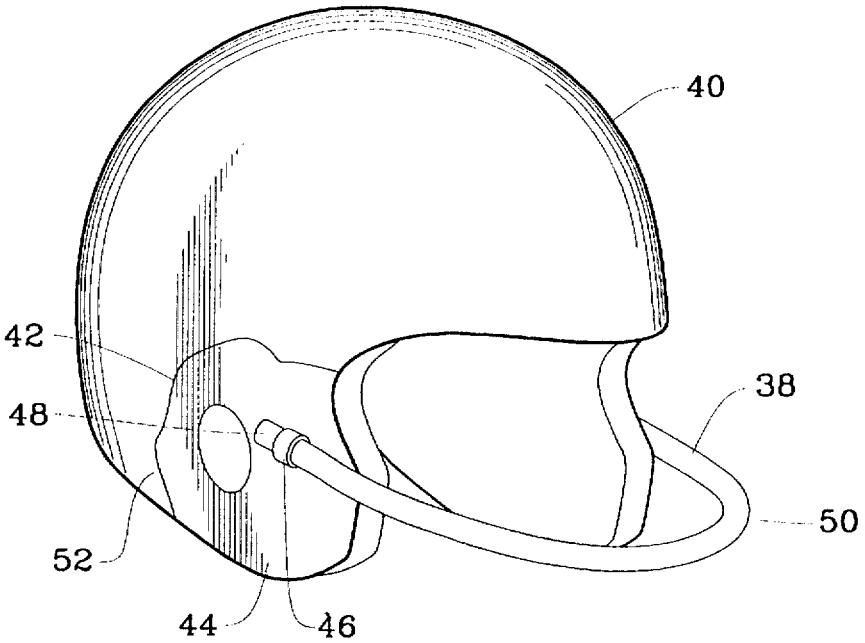
FIG. 5 is a side view of a helmet detailing the face guard attachment.

In yet another embodiment, FIG. 5 shows a single bar face mask 38 mounted on a helmet 40 wherein cutout 42 shows the hard inner shell 44 having an extruded, slidable mount 46 in its side. This mount 46 slidably receives the back end 48 of the mask so that when pressure is exerted on the face mask (as shown by arrow 50), the mask is slidably retained by mount 46, but is allowed to slide backwards into the surrounding foam layering 52. This will produce a cushioning effect for both the player wearing the helmet and provide a softer impact response from the striking object. Such a slidable mounting arrangement might be used in lieu of, or in addition to, the aforementioned padding as added to the exterior of the face mask.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and descriptions.

What is claimed is:

1. A safety helmet comprising: a rigid housing means forming a head encompassing structure defining an inner and an outer surface; an outer coating means secured to said entire outer surface of said structure formed from interconnecting preshaped pieces of vinyl nitrile sponge material being approximately ½ inch thick, said outer surface of said vinyl nitrile sponge material including an abrasion resistant coating; and an inner coating means formed from a soft resilient material secured to said entire inner surface of said structure forming a cushioning headliner positioned between said structure and the wearer's head.

2. The helmet according to claim 1 wherein said inner coating means is formed vinyl nitrile sponge material.

3. The helmet according to claim 1 wherein said abrasion resistant coating is urethane.

4. The helmet according to claim 1 wherein said structure is a one piece plastic shell.

5. The helmet according to claim 4 wherein said shell is perforated forming a web shape configuration.

6. The helmet according to claim 1 wherein said structure is a one piece metal shell.

7. The helmet according to claim 6 wherein said shell is perforated forming a web shape configuration.

8. The helmet according to claim 1 including a means for securing a face guard to said helmet.

9. The helmet according to claim 8 wherein said means for securing a face guard to said helmet includes an elongated slot in each side of said head encompassing structure allowing for the slidable attachment of said face guard whereby said outer covering means covers said elongated slot and slidably engaged face guard, said outer covering means material thereby inhibiting movement of said face guard.

10. A helmet and face mask assembly; said face mask having a protruding end and mounting ends, with said helmet and face mask assembly comprising:

a hard head encompassing shell with at inner and outer surface; a plurality of slidable mounts extruded on said outer surface of said hard shell for slidably receiving said face mask mounting ends; a soft, yet durable covering across said outer surface of said hard head shell for directly absorbing impacts to said helmet, with said covering also providing compressible resistance to the sliding movement of said face mask, said covering constructed from shaped pieces which are assembled to conform to said outer surface of said hard shell; and a cushioning headliner across said inner surface of said shell for providing a soft barrier between said hard head encompassing shell and the wearer's head.

11. The helmet according to claim 10 wherein said shaped pieces are made from ½ inch thick vinyl nitrile sponge material.

12. The helmet according to claim 10 wherein said assembled covering pieces are covered with an abrasion resistant material.

13. The helmet according to claim 12 wherein said abrasion resistant material is urethane.

* * * * *